United States Patent [19]

Nagatomo et al.

[11] 4,021,245

[45] May 3, 1977

[54] PHOTOGRAPHIC LIGHT-SENSITIVE MATERIAL

[75] Inventors: Shigeru Nagatomo; Kiyotaka Hori, both of Minami-ashigara, Japan

[73] Assignee: Fuji Photo Film Co., Ltd., Minami-ashigara, Japan

[22] Filed: Apr. 30, 1975

[21] Appl. No.: 573,239

[30] Foreign Application Priority Data

Apr. 30, 1974 Japan ..... 49-48572

[52] U.S. Cl. ..... 96/67; 96/50 PL; 96/94 R; 96/111; 96/114; 96/114.3; 96/114.7; 96/114.8; 96/114.9

[51] Int. Cl.² ..... G03C 1/76

[58] Field of Search ..... 96/67, 94 R, 111, 114, 96/114.3, 114.7, 114.8, 114.9, 50 PL

[56] References Cited

UNITED STATES PATENTS

| | | | |
|---|---|---|---|
| 3,856,526 | 12/1974 | Hamb et al. | 96/114 X |
| 3,864,132 | 2/1975 | Rash et al. | 96/67 X |
| 3,923,517 | 12/1975 | Yamanoto et al. | 96/67 X |
| 3,925,081 | 12/1975 | Chiklis | 96/67 X |

*Primary Examiner*—Mayer Weinblatt
*Attorney, Agent, or Firm*—Sughrue, Rothwell, Mion, Zinn & Macpeak

[57] ABSTRACT

A photographic light-sensitive material with an uppermost layer thereon containing a gelatin derivative and silicic anhydride colloid.

13 Claims, No Drawings

PHOTOGRAPHIC LIGHT-SENSITIVE MATERIAL

BACKGROUND OF THE INVENTION

1. Field of the Invention

This invention relates to a photographic light-sensitive material having improved processing properties and improved surface properties, and more particularly, it is concerned with a novel photographic light-sensitive material which is capable of forming rapidly a photographic image of good quality with a photographic processing at a high temperature and which has excellent adhesion resistance.

2. Description of the Prior Art

In photographic light-sensitive materials, in general, gelatin, other hydrophilic natural high molecular weight materials and/or hydrophilic synthetic high molecular weight materials are contained in silver halide emulsion layers, photographic auxiliary layers such as intermediate layers, protective layers and antihalation layers or undercoated layers between these layers and supports. Photographic light-sensitive materials containing these hydrophilic high molecular weight materials are ordinarily processed with various aqueous solutions differing in pH, salt concentration and liquid temperature in the steps of developing, stopping, fixing, water washing and bleaching in the case of color photographic materials, after exposure, to thus form photographic images.

When the processing temperature is higher as in the case of a rapid processing of a photographic light-sensitive material (operation for forming an image by carrying out development or other photographic processings rapidly) or when a number of processings for various purposes are carried out for a long time as in the case of a reversal color photographic material, many disadvantages are unavoidable in that the photographic light-sensitive emulsion layers and other layers swell and soften too much, resulting in a reduction of the physical strength or an occurrence of net patterns called "reticulation" on the surface.

These phenomena markedly reduced the commercial value of photographic light-sensitive materials regardless of whether they are black-and-white light-sensitive materials or color light-sensitive materials, and, therefore, these phenomena should be avoided. Recently, processing methods for photographic light-sensitive materials have been enlarged. For example, it has been required to increase the productivity in photographic processings by carrying out a processing at a high temperature such as 30° C, 38° C or 50° C, not at room temperature (e.g., 20° ~ 25° C) in the prior art, and thereby decreasing the time for the processing. As a technique capable of satisfying such a requirement, incorporation of a hardener in an amount of several times to several tens of times the conventional amount previously employed in a photographic light-sensitive emulsion layer or protective layer in the production of photographic light-sensitive material so as to impart sufficient physical strength to resist the severe processing conditions has been considered. According to this method, however, occurrence of reticulation can be prevented to some extent. However, a complete prevention is not possible and, rather, a phenomenon known as "after-hardening" tends to occur, such that, during storage of a photographic light-sensitive material, the physical strength of the emulsion film deteriorates gradually, thus resulting in difficulty in maintaining the photographic quality. Furthermore, this method has a disadvantage that a photographic layer is hardened to such a large extent that permeation or diffusion of a developer during development is hindered and the sensitivity is substantially reduced.

Other methods have been proposed in which a photographic material after exposure is treated with an aqueous solution containing a hardener, called a "pre-hardening bath", immediately before development, or development and hardening are simultaneously carried out using a developer containing a hardener. However, these methods have also the disadvantages that, depending on the types of hardeners used, unfavorable results are produced, for example, fog, deterioration of photographic properties and color contamination in the case of color photographic materials. Moreover, the types of hardeners and sensitive materials which can be used and the processing conditions should be limited to a narrow range in order to obtain photographic layers having the required physical strength in a short time without deteriorating the photographic properties. Above all, the method using a prehardening bath is not considered to be suitable for the purpose of decreasing the photographic processing time and facilitating the processing because the number of steps is increased.

As a further method for suppressing the occurrence of reticulation, application of carboxymethylated casein or ethyl cellulose sulfate sodium salt previously to the uppermost layer of a photographic light-sensitive material on the emulsion side instead of a gelatin protective layer has been reported (U.S. Defensive Publication T 887,012). This method is considered to be an advantageous method since it is not necessary to add a large amount of hardener to a photographic layer. However, carboxymethylated casein has a disadvantage that not only impurities contained therein, adversely influencing the photographic property, are difficult to remove, but also the aqueous solution thereof is difficult to coat onto an emulsion layer to form a uniform layer. Furthermore, ethyl cellulose sulfate sodium salt is not always suitable for use as a raw material in the production of a photographic light-sensitive material, since it is difficult to prepare the salt having a good solubility in water with a good reproducibility and storage stability over a long period of time, and the setting property when cooled after coating and coating property are not good as would be somewhat predicted from a consideration of the chemical structure of the sulfuric acid ester.

On the other hand, silver halide photographic materials generally have a surface layer containing a hydrophilic colloid such as gelatin as a binder. Therefore, the surface of the photographic material exhibits an increased adhesiveness are tackiness in an atmosphere of high humidity, in particular, high humidity and high temperature, and tends to adhere easily to other materials. This phenomenon of adhesion takes place often between photographic materials or between a photographic material and other materials during production, photographing, processing, projection or storage, often resulting in accidents.

In order to solve this problem, incorporation in a surface layer of fine particles of an inorganic substance such as silicon dioxide, magnesium oxide, titanium dioxide or calcium carbonate or an organic substance such as polymethyl methacrylate or cellulose acetate propionate, having a particle size of about 0.3 to 5 microns in diameter, to increase the roughness of the surface or to matt the surface, thus decreasing the adhesiveness of the surface, is well known in the art. In the practice of this method, however, there are disadvantageous side effects since a uniformly coated layer is not obtained due to aggregation in the coating liquor containing such a substance, a photographic material tends to be scratched due to its low slippage properties, the motion of a film in a camera or a projector is disturbed, the transparency of the image formed is reduced and the graininess of the image is deteriorated. Therefore, it has hitherto been desired to improve the adhesion resistance of a photographic material without these disadvantageous side effects.

As described above, reticulation and adhesion are very important problems in the photographic industry, but it is difficutl to solve simultaneously these two problems using prior art methods.

SUMMARY OF THE INVENTION

An object of the invention is to provide a photographic light-sensitive material which is capable of forming an image of high quality rapidly by photographic processings.

Another object of the invention is to provide a photographic light-sensitive material having excellent adhesion resistance and free of reticulation.

Efforts have been made to solve the above-described problems and consequently it has been found that these objects are accomplished by a photographic light-sensitive material in which the uppermost layer contains a gelatin derivative and silicic anhydride colloid.

DETAILED DESCRIPTION OF THE INVENTION

U.S. Pat. No. 3,923,517 discloses that gelatin derivatives are very effective for preventing reticulation, but, on the other hand, have the disadvantage that adhesion resistance is deteriorated. When silicic anhydride colloid is used for the gelatin commonly used in the photographic industry, the adhesion resistance is increased but reticulation tends to occur. Now, it has been found that the combined use of a gelatiin derivative and silicic anhydride in the uppermost layer of a photographic light-sensitive material results in a marked improvement in adhesion resistance without the occurrence of reticulation, which would not have been predicted from common knowledge in the art.

By the practice of the present invention, the advantage that a photographic light-sensitive material having high quality photographic and physical properties can be obtained. That is to say, according to the present invention, a photographic light-sensitive material having excellent adhesion resistance can be obtained without a change of the photographic and physical properties, a deterioration of the photographic properties, for example, the occurrence of fog and a reduction of the sensitivity, at a high temperature or over a wide range of pH, and the occurrence of reticulation after processing. Furthermore, the present invention has the additional advantage that production can be carried out without difficulty, since the gelatin derivative and the silicic anhydride colloid used in the uppermost layer of the photographic light-sensitive material are quite miscible with other high molecular weight materials, the dispersion of these materials is quite stable and the formation of a uniform coated layer is easy.

The silicic anhydride colloid used in the invention is a colloidal solution in which fine grains of silicic anhydride are dispersed in an organic solvent such as methanol or ethanol, or water as a dispersing medium. In general, a colloidal solution of the silicic anhydride used in the invention suitably contains a dispersoid with a grain size of about 1 nm to 150 nm, preferably a grain size of 1 nm to about 100 nm, and especially preferably 5 nm to 40 nm.

Colloidal silica dispersed in a solution is preferred as the silicic anhydride colloid, but a colloidal dispersion of other materials such as powdered silica, kaolin, diatomaceous earth and bentonite containing silicic anhydride provide a similar effect and are suitable.

The gelatin derivative used in the invention means a chemically modified gelatin formed as a result of a reaction of the amino groups, imino groups, carboxyl groups and/or hydroxyl groups of various amino acids making up the gelatin molecule with a monofunctional compound. The term "gelatin" as used herein as a starting material of the gelatin derivatives according to the invention means those protein materials derived from collagen. Moreover, gelatin includes any other products substantially similar thereto, for example, where such materials are synthetically produced. Generally gelatin includes the so-called "alkali-treated" gelatin obtained by treatment with lime in the production step from collagen, the so-called "acid-treated" gelatin obtained by treatment with hydrochloric acid, etc., the so-called "enzyme-treated" gelatin obtained by enzymatic hydrolysis and low molecular weight gelatins obtained through hydrolysis of these gelatins by various means, as is well known in the art. Any of these gelatins can be used for the production of gelatin derivatives necessary for the practice of the present invention and detailed descriptions appear in Arthur Veis, *The Macromolecular Chemistry of Gelatin*, pp. 186 ~ 217, Academic Press (1964).

Any compounds having in the molecule one functional group reactive with an amino group, an imino group, a carboxyl group and/or a hydroxyl group in the gelatin molecule can be used as the monofunctional compound necessary for the preparation of the gelatin derivative of the invention. Typical examples of such functional groups are —NCO, —NCS, —$NHCOSO_3M$, —$NHCSSO_3M$ whrein M represents an alkali metal such as a sodium or potassium atom,

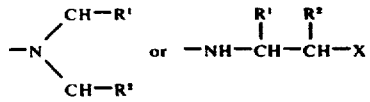

wherein $R^1$ and $R^2$ each represents a hydrogen atom or an alkyl group such as methyl, ethyl, propyl, butyl and isobutyl groups and X represents a halogen atom such as a chlorine, bromine or fluorine atom,

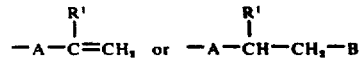

wherein $R^1$ has the same meaning as above, A represents an electron attracting group capable of activating the terminal ethylene bond, such as a cyano, phenylsulfonyl, sulfamoyl, carbamoyl, sulfonyl or carbonyl group and B represents an atom or group of atoms capable of forming the terminal ethylene bond through formation of an acid with the hydrogen combined with the adjacent carbon atom followed by release, such as a bromine atom, a chlorine atom, an acetyl group or a sulfonic acid ester group, $-SO_2X$ wherein X has the same meaning as above, —COX wherein X has the same meaning as above,

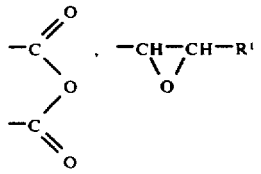

wherein $R^1$ has the same meaning as above,

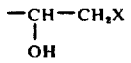

wherein X has the same meaning as above, $-CH_2X$ wherein X has the same meaning as above, $-COOR^3$ wherein $R^3$ represents an aryl group having an electron attracting group at the o- or p-position, such as o-nitrophenyl, p-nitrophenyl or p-carboxylphenyl group, and

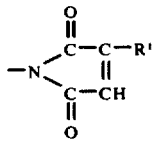

wherein $R^1$ has the same meaning as above.

Typical examples of compounds containing the abovedescribed functional group, suitable for the production of the gelatin derivatives used in the invention, are isocyanates or their precursors such as phenyl isocyanate, p-tolyl isocyanate, 4-bromophenyl isocyanate, 4-chlorophenyl isocyanate, 2-nitrophenyl isocyanate, 4-ethyoxycarbonylphenyl isocyanate, 1-naphthyl isocyanate, pheny isocyanate·bisulfite adduct and biphenyl-4-isocyanate·bisulfite adduct; thioisocyanates or their precursors such as phenyl thioisocyanate, p-tolyl thioisocyanate and phenyl thioisocyanate·bisulfite adduct; aziridines or their precursors such as N-pentanoyl-2-ethyl-1-aziridine, 1-phenylcarbamoylaziridine, 2-methyl-1-phenylcarbamoylaziridine, 1-dimethylaminosulfonylaziridine, 1-benzoylaziridine, 4-nitrobenzoyl-1-aziridine, 1-(2-chlorophenyl)carbamoyl-1-aziridine, 1-(3-methylphenyl)-carbamoylaziridine, 1-(n-butylsulfonyl)aziridine, 1-(phenylsulfonyl)-2-methylaziridine, 2-(1-aziridinyl)-4,6-bis(ethylamino)-1,3,5-triazine and 1-phenyl-3-(2-chloroethyl)urea; active vinyl compounds or their precursors such as N-vinylsulfonyl-p-toluidine, vinylsulfonylbenzene, 1-methyl-4-vinylsulfonylbenzene, acrylonitrile, 1-(hydroxysulfonyloxy)-2-(4-methoxyphenylsulfonyl)ethane and 2-phenylcarbamoylethyl bromide; sulfonyl halides such as benzenesulfonyl chloride, 4-methoxybenzenesulfonyl chloride, 4-phenoxybenzenesulfonyl chloride, 4-chlorobenzenesulfonyl chloride, 4-bromobenzenesulfonyl chloride, 4-methylbenzenesulfonyl chloride, 3-nitrobenzenesulfonyl chloride, 3-carboxybenzenesulfonyl chloride, 2-naphthalenesulfonyl chloride, 4-aminobenzenesulfonyl fluoride, 3,4-diaminobenzenesulfonyl fluoride and 3-carboxybenzenesulfonyl fluoride; carboxyl halides such as 4-nitrobenzoyl chloride and 4-carboxybenzoyl bromide; acid anhydrides such as succinic anhydride, phthalic anhydride, hexahydrophthalic anhydride, isatoic anhydride, monomethylsuccinic anhydride, glutaric anhydride, benzoic anhydride, trimellitic anhydride, 3,6-dichlorophthalic anhydride, diglycolic anhydride and nitrophthalic anhydride; compounds containing an oxirane ring or their precursors such as 3-phenoxy-1,2-epoxypropane, 3-(3-methylphenoxy)-1,2-epoxypropane, 3-(2,4-dibromophenoxy)-1,2-epoxypropane, 3-(4-acetylaminophenoxy)-1,2-epoxypropane, 3-(2-biphenyloxy)-1,2-epoxypropane, 3-(2,4-dinitro-1-naphthoxy)-1,2-epoxypropane, 1-chloro-2-hydroxy-3-phenoxypropane, epichlorohydrin and 1-bromo-2-hydroxy-3-(2-chlorophenyl)propane; halomethyl compounds such as bromoacetic acid and chloroacetic acid; active esters such as o-nitrophenyl benzoate, p-nitrophenyl acetate, and p-nitrophenyl-1-hydroxynaphthoate; and maleimides such as N-ethylmaleimide, N-phenylmaleimide, N-(p-carboxyphenyl)-maleimide, N-(p-sulfophenyl)maleimide and N-(carboxymethyl)maleimide.

These compounds have the function of chemically modifying gelatin by the method described hereinafter and the gelatin derivatives thus-obtained are effective for the high temperature rapid processing as described above as a material to be used in the uppermost layer of a photographic light-sensitive material according to the invention. Of the above-described compounds, isocyanates such as phenyl isocyanate and p-tolyl isocyanate, aziridines such as 1-phenylcarbamoylaziridine, 2-methyl-1-phenylcarbamoylaziridine, 1-dimethylaminosulfonylaziridine and 1-benzoylaziridine, and sulfonyl halides such as benzenesulfonyl chloride, 4-methoxybenzenesulfonyl chloride, 4-chlorobenzenesulfonyl chloride, 4-bromobenzenesulfonyl chloride and 4-methylbenzenesulfonyl chloride are particularly preferred because they are readily obtainable and economical and also have a remarkable effect in preventing reticulation at high temperature.

Preparation of the gelatin derivative necessary for the practice of the invention is generally carried out by reacting gelatin with the above-descrivbed monofunctional compound (having in the molecule one functional group reactive with the reactive groups in the gelatin molecule) in a solvent for gelatin, for example, water, an organic solvent such as dimethyl sulfoxide, N,N-dimethylformamide, N,N-dimethylacetamide, tetramethylurea, tetramethylsulfone or acetic acid or a mixture of water and such an organic solvent, optionally in the presence of a base such as sodium hydroxide, potassium hydroxide, etc., or an acid such as hydrochloric acid, sulfuric acid, phosphoric acid, etc., as a pH regulator, e.g., as described in U.S. Pat. No. 2,614,928 and *J. Appl. Chem.*, 15, 479 (1965).

In the present invention, a gelatin derivative and silicic anhydride colloid need not be incorporated in the photographic light-sensitive emulsion layer near the support, and need to be incorporated in the uppermost layer only. Two or more gelatin derivatives can be used in combination, if desired. The object of the invention can also be accomplished by providing a layer containing a gelatin derivative and a silicic anhydride colloid as the uppermost layer of a photographic light-sensitive material having a conventional protective layer.

The binder of the uppermost layer provided in the photographic of the invention can be either a gelatin derivative as described above or a mixture of a gelatin derivative and another high molecular weight material(s). All known materials can be used as the high molecular weight material, for example, hydrophilic high molecular weight materials such as non-chemically-modified gelatins, that is, acid-treated gelatin, alkali-treated gelatin and enzyme-treated gelatin. Other useful examples are proteins such as albumin and casein, saccharides such as agar, dextran, gum arabic, starch and carboxymethyl starch, cellulose derivatives such s carboxymethyl cellulose, hydroxyethyl cellulose and carboxymethylhydroxyethyl cellulose and hydrophilic synthetic high molecular weight materials such as polyvinyl alcohol, partial hydrolyzates of polyvinyl acetate, poly-N-vinylpyrrolidone, polyacrylamide, polyacrylic acid and copolymers of maleic anhydride and other vinyl compounds. These materials can be used individually or in combination. As described in U.S. Pat. Nos. 2,376,005, 2,739,137, 2,853,457, 3,062,674, 3,411,911, 3,488,708, 3,525,620, 3,635,715, 3,607,290 and 3,645,740 and British Pat. Nos. 1,186,699 and 1,307,373, aqueous dispersed latexes of copolymers or homopolymers of alkyl acrylates, alkyl methacrylates, acrylic acid, methacrylic acid, sulfoalkyl acrylates, sulfoalkyl methacrylates, glycidyl acrylates, glycidyl methacrylates, hydroxyalkyl acrylates, hydroxyalkyl methacrylates, alkoxyalkyl acrylates, alkoxyalkyl methacrylates, styrene, butadiene, vinyl chloride, maleic anhydride, maleamic acid and itaconic anhydride can additionally be used or, as the occasion demands, graft-type emulsion polymerization latexes obtained by polymerization of the above-described vinyl compounds in the presence of hydrophilic high molecular weight protective colloids can preferably be used individually or in combination with other hydrophilic high molecular weight materials. Furthermore, mixtures of the above-described high molecular weight materials can preferably be used.

The mixing ratio of the gelatin derivative and the high molecular weight material as described above is not particularly limited, but the gelatin derivative is preferably employed in an amount of about 10% by weight or more, particularly, 20% by weight or more, based on the total weight of the binder forming the uppermost layer. If the amount of the gelatin derivative is less than about 10% by weight based on the total weight of the binder forming the uppermost layer, sometimes the effect of preventing reticulation due to photographic processings is not sufficient.

Since the gelatin derivative of the invention or a mixture of the same with the above-described high molecular weight material is miscible with silicic anhydride colloid in appropriate proportions, the amount of silicic anhydride colloid to be added is not particularly limited. However, if the proportion of silicic anhydride colloid is too small, the adhesion resistance is insufficient, while if the proportion is too large, the viscosity is too high to coat in simple manner. In either case where the binder of the uppermost layer comprises a gelatin derivative only or where the binder comprises a mixture of a gelatin derivative and a high molecular weight material as described above, the solid content of the silicic anhydride colloid is preferably about 0.05 to 2 g, particularly, 0.3 to 1.5 g per g of the binder.

The object of the invention can be advantageously accomplished by the combined use of a matting agent in the uppermost layer containing at least a gelatin derivative and the silicic anhydride colloid. Fine particles of water-insoluble organic or inorganic compounds having an average particle size of, preferably, about 0.2 to 10 microns, more particularly, 0.3 to 5 microns can be used as this matting agent. Examples of suitable organic compounds are water-dispersable vinyl polymers such as polymethyl acrylate, polymethyl methacrylate, polyacrylonitrile, acrylonitrile-$\alpha$-methylstyrene copolymers, polystyrene, styrene-divinylbenzene copolymers, polyvinyl acetate, polyethylene carbonate and polytetrafluoroethylene, cellulose derivatives such as methyl cellulose, ethyl cellulose, cellulose acetate and cellulose acetate propionate, starch and starch derivatives such as carboxy starch, carboxynitrophenyl starch and urea-formaldehyde-starch reaction products, and gelatins hardened with conventional hardeners and hardened gelatin containing microcapsules (hollow). Examples of suitable inorganic compounds are silicon dioxide, titanium dioxide, magnesium dioxide, aluminum oxide, barium sulfate, calcium sulfate, silver chloride and silver bromide desensitized in a conventional manner and glass. These matting agents can, if desired, be used as combination of different materials, and a suitable amount of matting agent can range from about 1 to 100 mg, preferably 5 to 30 mg, per g of the binder in the surface layer.

In order to increase the effect of the invention, it is desirable to incorporate suitable amounts of hardeners and smoothening agents in the uppermost layer containing the above-described gelatin derivative aand silicic anhydride colloid. It is well known that the addition of such additives to the protective layer of a conventional photographic light-sensitive material is necessary to enhance the effect of the protective layer and, in the present invention, such additives can also be used in the uppermost layer. That is to say, a hardener serves to harden suitably the uppermost layer and to maintain the physical strength of the surface layer. Examples of suitable hardeners which can be advantageously used are aldehyde compounds such as formaldehyde and glutaraldehyde; ketone compounds such as diacetyl and cyclopentadione; compounds containing reactive halogens such as bis(2-chloroethylurea), 2-hydroxy-4,6-dichloro-1,3,5-triazine and those described in U.S. Pat. Nos. 3,288,775 and 2,732,303 and British Pat. Nos. 974,723 and 1,167,207; reactive olefin compounds such as divinylsulfone, 5-acetyl-1,3-diacryloylhexahydro-1,3,5-triazine and those described in U.S. Pat. Nos. 3,635,718 and 3,232,763 and British Pat. No. 994,869; N-methylol compounds such as N-hydroxymethylphthalimide and those described in U.S. Pat. Nos. 2,732,316 and 2,586,168; isocyanates as described in U.S. Pat. No. 3,103,437; aziridines as described in U.S. Pat. Nos. 3,017,280 and 2,983,611; acid derivatives as described in U.S. Pat. Nos. 2,725,294 and 2,725,295; carbodiimide compounds as described in U.S. Pat. No. 3,100,704; epoxy compounds as described in U.S. Pat. No. 3,091,537; isoxazole compounds as described in U.S. Pat. Nos. 3,321,313 and 3,543,292; halocarboxyaldehydes such as mucochloric acid; dioxane derivatives such as dihydroxydioxane and dichlorodioxane; high molecular weight hardeners such as the dialdehyde derivatives of starch and other polysaccharides and other polymers, for example, the half ester of maleic acid with polyvinyl alcohol or partially acetylated cellulose, maleamic acids derived from the reaction of gelatin or polyvinylamine with maleic anhydride, copoly(ethylene-maleic anhydride) and the bisulfite adduct of polyacrolein, etc., and inorganic hardeners such as chrome alum and zirconium sulfate. Instead of the above-described compounds, hardener precursors can be used, for example, alkali metal and bisulfite aldehyde adducts, methylol derivatives of hydantoin and primary aliphatic nitro alcohols. A suitable amount of hardener can range from about 2 to 80 mg, preferably 10 to 50 mg per g of the binder in the surface layer.

The smoothening agent is effective to provide adhesion resistance similar to the effect of the matting agent and to improve the friction properties related to camera adaptation in picture taking or photographing. Preferred examples of smoothening agents are waxes such as liquid paraffins and higher fatty acid esters, polyfluorinated hydrocarbons or their derivatives and silicones such as polyalkyl polysiloxanes, polyaryl polysiloxanes, polyalkylaryl polysiloxanes or the alkylene oxide adducts thereof. A suitable amount of smoothening agent can range from about 1 to 100 mg, preferably 10 to 50 mg, per g of the binder in the surface layer.

Surfactants can be added individually or in combination to a dispersion for the uppermost layer. These surfactants are used usually for the purpose of preventing unevenness on coating as a coating aid, but sometimes are added for other purposes, for example, improvement in emulsification or dispersion and serving as an aid or as a promoter with other materials in preventing adhesion or the generation of static charges in a finished light-sensitive material.

These surfactants can be classified as natural surfactants such as saponin, nonionic surfactants such as those of the alkylene oxide, glycerin and glycidol type, cationic surfactants such as higher alkylamines, quaternary ammonium salts, pyridine and other heterocyclic compounds, and phosphoniums and sulfoniums, anionic surfactants such as those containing acidic groups such as carboxylic acid, sulfonic acid, phosphoric acid, sulfuric acid ester and phosphoric acid ester groups, and amphoteric active agents such as amino acids, aminosulfonic acids and sulfuric acid or phosphoric acid esters of amino alcohols. Examples of suitable surfactants which can be used are described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174 and 3,545,974, DOS 1,942,665 and British Pat Nos. 1,077,317 and 1,198,450, Ryohei Oda et al., *Kaimen Kasseizai no Gosei to Oyo* (*Synthesis and Application of Surfactants*), published by Maki Shoten (1964); A. W. Perry, *Surface Active Agents*, published by Interscience Publication Inc., (1958); and J. P. Sisley, *Encyclopedia of Surface Active Agents*, Vol. 2, published by Chemical Publishing Co., (1964). A suitable amount of surface active agent used in this invention can range from about 0.5 to 50 mg, preferably 1 to 20 mg, per g of the binder in the surface layer.

In the practice of the invention, a silver halide emulsion is generally prepared by mixing a solution of water-soluble silver salt such as silver nitrate and a solution of a water-soluble halogen salt such as potassium bromide in the presence of a solution of a water-soluble high molecular weight material such as gelatin. Silver chloride, silver bromide and mixed silver halides such as silver chlorobromide, silver iodobromide and silver chloroiodobromide can be used as the silver halide. The grain shape of the silver halide grains can be that of a cubic system, an octahedral system and a mixed crystal system thereof. The grain diameter and grain size distribution are not particularly limited. These silver halide grains can be prepared by conventional methods. They are preferably prepared by the so-called single or double jet method or control double jet method. Two or more silver halide photographic emulsions prepared separately can be mixed. Furthermore, the crystal structure of the silver halide grains can be even throughout the exterior and interior, different between the exterior and interior to form a laminar structure or the so-called conversion type silver halide grains as described in British Pat. No. 635,841 and U.S. Pat. No. 3,622,318. The silver halide emulsion can be either a type wherein a latent image is formed mainly on the surface of the grains or a type wherein a latent image is formed in the interior of grains.

These photographic emulsions can be prepared by various methods, for example, an ammonia method, a neutral method and an acidic method as described in C. E. K. Mees & T. H. James, *The Theory of the Photographic Process*, MacMillan Co., New York, (1966) and P. Glafkides, *Chimie Photographique*, Paul Montel, Paris, (1957).

The silver halide grains, after being formed, are washed with water to remove the by-produced water-soluble salts, for example, potassium nitrate in the case of preparing silver bromide from silver nitrate and potassium bromide from the system and then subjected to a heat treatment in the presence of a chemical sensitizer such as sodium thiosulfate, N,N,N'-trimethylurea, a thiocyanate complex salt of monovalent gold, a thiosulfate complex salt of monovalent gold, stannous chloride or hexamethylenetetramine to increase the sensitivity without coarsening the grains. suitable sensitizing methods are described in the above literature.

The silver halide emulsion can be subjected to chemical sensitization in a conventional manner. Examples of suitable chemical sensitizers are gold compounds such as chloroaurate and gold trichloride as described in U.S. Pat. Nos. 2,399,083, 2,540,085, 2,597,856 and 2,597,915, salts of noble metals such as platinum, palladium, iridium, rhodium and ruthenium as described in U.S. Pat. Nos. 2,448,060, 2,540,086, 2,566,245, 2,566,263 and 2,598,079, sulfur compounds capable of forming silver sulfide by the reaction with a silver salt as described in U.S. Pat. Nos. 1,574,944, 2,410,689, 3,189,458 and 3,501,313, and stannous salts, amines and other reducing materials as described in U.S. Pat. Nos. 2,487,850, 2,518,698, 2,521,925, 2,521,926, 2,694,637, 2,983,610 and 3,201,254.

Various compounds can be added to the photographic emulsions for the purpose of preventing a reduction of the sensitivity and the occurrence of fog during production, processing and storage of the light-sensitive materials. These compounds include, for example, 4-hydroxy-6-methyl-1,3,3a,7-tetrazaindene, 3-methyl-benzothiazole, 1-phenyl-5-mercaptotetrazole, many other heterocyclic compounds, mercury containing compounds, mercapto compounds and metal salts, which are well known in the art. Examples of these compounds are described in C. E. K. Mees & T. H. James, *The Theory of the Photographic Process*, 3rd Ed., pp. 344 ~ 349, Macmillan & Co., New York (1966), and U.S. Pat. Nos. 1,758,576, 2,110,178, 2,131,038, 2,173,628, 2,697,040, 2,304,962, 2,324,123, 2,394,198, 2,444,605~8, 2,566,245, 2,694,716, 2,697,099, 2,708,162, 2,728,663~5, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668, and 3,622,339 and British Patent Nos. 893,428, 403,789, 1,173,609 and 1,200,188.

If desired, the photographic emulsions can be subjected to spectral sensitization or supersensitization using cyanine dyes such as cyanine, merocyanine and carbocyanine dyes individually or in combination, or together with styryl dyes. These color sensitization techniques are well known as disclosed in U.S. Pat. Nos. 2,493,748, 2,519,001, 2,977,229, 3,480,434, 3,672,897, 3,703,377, 2,688,545, 2,912,329, 3,397,060, 3,615,635, 3,628,964, 3,511,664, 3,522,052, 3,527,641, 3,615,613, 3,615,632, 3,617,295, 3,635,721 and 3,694,217: British Pat. Nos. 1,195,302, 1,242,588, 1,293,862, 1,137,580 and 1,216,203; DOS 2,030,326 and 2,121,780; Japanese Patent Publication Nos. 4,936/1968, 14,030/1969 and 10,773/1968. Selection of the sensitizers can be optionally carried out depending on the object or use of the light-sensitive material, for example, the wavelength region to be sensitized or the sensitivity desired.

Moreover, a color coupler can be incorporated in the photographic light-sensitive emulsion layer. Examples of suitable color couplers are 4- or 2-equivalent type diketomethylene yellow couplers such as the compounds described in U.S. Pat. Nos. 3,415,652, 3,447,928, 3,311,476 and 3,408,194, the compounds described in U.S. Pat. Nos. 2,875,057, 3,265,506, 3,409,439, 3,551,155 and 3,551,156 and the compounds described in Japanese Patent Application (OPI) Nos. 26,133/1972 and 66,836/1973; 4- or 2-equivalent type pyrazolone magenta couplers and indazolone magenta couplers such as the compounds described in U.S. Pat. Nos. 2,600,788, 2,983,608, 3,062,653, 3,214,437, 3,253,924, 3,419,391, 3,419,808, 3,476,560 and 3,582,322, Japanese Patent Publication No. 20,636/1970 and Japanese Patent Application (OPI) No. 26,133/1972; and α-naphthol type cyan couplers and phenol type cyan couplers such as the compounds described in U.S. Pat. Nos. 2,474,293, 2,698,794, 3,034,892, 3,214,437, 3,253,924, 3,311,476, 3,458,315 and 3,591,383 and Japanese Patent Publication Nos. 11,304/1967 and 32,461/1969. In addition, DIR couplers can be used as disclosed in U.S. Pat. Nos. 3,227,554, 3,297,445, 3,253,924, 3,311,476, 3,379,529, 3,516,831, 3,617,291 and 3,705,801, and DOS 2,163,811.

Hardeners and surfactants can be incorporated in photographic light-sensitive emulsions, which can be selected from those used in the uppermost layer containing the gelatin derivative and the silicic anhydride colloid. The hardener is effective for hardening suitably the light-sensitive emulsion layer and the other layers to maintain the physical strength thereof. The surfactant is used usually as a coating aid for the purpose of preventing the occurrence of unevenness during coating a light-sensitive emulsion layer or other layers, but, sometimes, for other purposes, for example, improvement of emulsification and dispersion, sensitization and photographic properties and serving as an aid or as a promoter with other materials to prevent adhesion or the generation of static charges in a finished light-sensitive material.

These photographic emulsion layers and uppermost layers are coated on substantially planar materials which do not undergo a marked dimension change during processing, for example, rigid supports such as glass, metals and ceramics or flexible supports depending on the objects. A suitable thickness of the uppermost layer can range from 0.2 to 5.0 μ, preferably 0.5 to 3.0 μ.

Typical examples of flexible supports commonly used in photographic light-sensitive materials are a cellulose nitrate film, a cellulose acetate film, a cellulose acetate butyrate film, a cellulose acetate propionate film, a polystyrene film, a polyethylene terephthalate film, a polycarbonate film, laminates thereof, thin glass film and paper. Baryta papers or papers coated or laminated with α-olefin polymers, in particular, those having 2 to 10 carbon atoms, such as polyethylene, polypropylene and ethylene-butene copolymers and synthetic resin films whose surface is coarsened to increase the adhesiveness to other high molecular weight materials as well as the printability, as shown in Japanese Patent Publication No. 19,068/1972, can be used as a support with good results.

Transparent supports can be employed depending on the end-use objects of the light-sensitive material. In the case of transparent supports, not only colorless transparent supports but also colored transparent supports which contain dyes or pigments can be employed. This type of support is disclosed in *J. SMPTE*, 67, 296 (1958) and has been utilized in X-ray films.

Opaque supports include naturally opaque supports such as paper, transparent films containing dyes or pigments such as titanium oxide, synthetic resin films surface treated by the method described in Japanese Patent Publication No. 19,068/1972 and papers or plastic films opacified completely with carbon black or dyes. Where the adhesiveness between the support and the photographic emulsion layer is insufficient, a layer adhesive to the both can be provided as an undercoated layer. Furthermore, the surface of the support can be subjected to a pretreatment such as a corona discharge, an irradiation with ultraviolet light or a flame treatment so as to enhance the adhesiveness.

Each layer of the photographic light-sensitive material can be coated using various coating methods, for example, dip coating, air knife coating, curtain coating and extrusion coating using a hopper as described in U.S. Pat. No. 2,681,294. If desired, two or more layers can simultaneously be coated using the methods as described in U.S. Pat. Nos. 2,761,791, 3,508,947, 2,941,898 and 3,526,528. A spraying method or a method of adhering a gelled layer can also be employed.

The following examples of the gelatin derivative of the invention and examples of using the same are given in order to illustrate the invention in greater detail without limiting the invention. Unless otherwise indicated, all parts, percents, ratios and the like are by weight.

The synthesis of the gelatin derivatives was carried out according to the method described in Japanese Patent Application No. 18,624/1973.

| Gelatin Derivative | Abbreviation |
|---|---|
| Phenyl Isocyanate-treated Gelatin | Gd-1 |
| 1-Phenylcarbamoylaziridine-treated Gelatin | Gd-2 |
| Benzenesulfonyl Chloride-treated Gelatin | Gd-3 |
| 4-Methylbenzenesulfonyl Chloride-treated Gelatin | Gd-4 |
| 3-Phenoxy-1,2-Epoxypropane-treated Gelatin | Gd-5 |

-continued

| Gelatin Derivative | Abbreviation |
|---|---|
| Phthalic Anhydride-treated Gelatin | Gd-6 |

EXAMPLE 1

On an undercoated cellulose triacetate film support were coated, from the support side, a red-sensitive silver halide emulsion layer, an intermediate layer, a green-sensitive silver halide emulsion layer, a yellow filter layer, a blue-sensitive silver halide emulsion layer and an uppermost layer containing the additives as shown in Table 1 to obtain Samples 1 to 11. In the uppermost layer were used gelatin, gelatin derivatives and silicic anhydride colloid in the following manner. An aqueous dispersion of silicic anhydride colloid having an average particle diameter of 20 nm and a pH of 8.5 was used.

| Sample | Composition |
|---|---|
| Sample 1 | Gelatin only |
| Sample 2 | Gd-1 |
| Sample 3 | Gelatin + Silicic Anhydride Colloid (0.5 g/l g Binder) |
| Sample 4 | Gd-1 + Silicic Anhydride Colloid (0.5 g/l g Binder) |
| Sample 5 | Gd-1 (60%) + Gelatin (40%) + Silicic Anhydride Colloid (0.5 g/l g Binder) |
| Sample 6 | Gd-1 (20%) + Gelatin (80%) + Silicic Anhydride Colloid (0.5 g/l g Binder) |
| Sample 7 | Gd-2 + Silicic Anhydride Colloid (0.5 g/l g Binder) |
| Sample 8 | Gd-3 + Silicic Anhydride Colloid (0.5 g/l g Binder) |
| Sample 9 | Gd-4 + Silicic Anhydride Colloid (0.5 g/l g Binder) |
| Sample 10 | Gd-5 + Silicic Anhydride Colloid (0.5 g/l g Binder) |
| Sample 11 | Gd-6 + Silicic Anhydride Colloid (0.5 g/l g Binder) |

8.3 mg of 2,4-dichloro-6-hydroxy-1,3,5-triazine sodium salt was added to all of the samples as a hardener per g of the binder, and the samples were coated in a film thickness of 1.5 microns on dry basis and dried at a temperature of 25° C and relative humidity of 60%.

These samples were kept at a temperature of 25° C and a relative humidity of 60% for one week and then subjected to the following color negative processing, followed by an evaluation of the reticulation occurred.

At the same time, the processing temperature was kept at 35° C.

| | | |
|---|---|---|
| Color Development | 3 | minutes |
| Bleaching | 6 | " |
| Water Washing | 3 | " |
| Fixing | 6 | " |
| Water Washing | 3 | " |
| Stabilizing Bath | 3 | " |

The compositions of the color negative processing baths used were as follows:

| | |
|---|---|
| Color Developer | |
| Sodium Sulfate | 2.0 g |
| Sodium Carbonate (monohydrate) | 30.0 g |
| Potassium Bromide | 2.0 g |
| Benzyl Alcohol | 5.0 ml |
| Hydroxylamine Sulfate | 1.6 g |
| 4-Amino-3-methyl-N-ethyl-N-(β-hydroxyethyl)aniline | 4.0 g |
| Water to make | 1000 ml |
| Bleaching Solution | |
| Iron-Sodium Ethylenediamine-tetraacetate | 100.0 g |
| Potassium Bromide | 60.0 g |
| Ammonium Hydroxide (28% aq. soln.) | 50.0 ml |
| Glacial Acetic Acid | 25.0 ml |
| Water to make | 1000 ml |
| Fixing Solution | |
| Sodium Sulfate | 10.0 g |
| Sodium Thiosulfate | 200.0 g |
| Water to make | 1000 ml |
| Stabilizing Bath | |
| Formalin (40%) | 10.0 ml |
| Water to make | 1000 ml |

Samples 1 to 11 were then subjected to adhesion testing. The adhesion test was carried out by cutting each

TABLE 1

| Component | Red-Sensitive Silver Halide Emulsion Layer | Green-Sensitive Silver Halide Emulsion Layer | Blue-Sensitive Silver Halide Emulsion Layer | Intermediate Layer | Yellow Filter Layer |
|---|---|---|---|---|---|
| Color Forming Agent | 4-Chloro-1-hydroxy-N-dodecyl-2-naphthamide (0.88 g/m²) | 1-(2,4,6-Trichlorophenyl)-3-(3-(2,4-di-t-amylphenoxy)-acetamide)-benzamide-5-pyrazolone (0.75 g/m²) | 3'-(2,4-Di-t-amylphenoxy-acetamide)-α-(4-methoxybenzoyl)-acetanilide (1.31 g/m²) | — | — |
| Spectral Sensitizer | bis(9-Ethyl-5-chloro-3-β-hydroxyethyl)-thiacarbocyanine bromide (6.51 mg/m²) | bis(9-Ethyl-5-phenyl-3-ethyl)-oxycarbocyanine isothiocyanate (5.23 mg/m²) | None | — | — |
| Stabilizer[1] | (8.19 mg/m²) | (7.71 mg/m²) | (6.50 mg/m²) | — | — |
| Hardener[2] | (15 mg/m²) | (14 mg/m²) | (20 mg/m²) | (10 mg/m²) | (11 mg/m²) |
| Coating Aid[3] | (42 mg/m²) | (51 mg/m²) | (67 mg/m²) | (56 mg/m²) | (63 mg/m²) |
| [4] | (53 mg/m²) | (64 mg/m²) | (84 mg/m²) | (71 mg/m²) | (80 mg/m²) |
| | Silver Iodobromide Emulsion (silver iodide: 5.5 mol%) (2.85 g/m²) | Silver Iodobromide Emulsion (silver iodide: 5.5 mol%) (4.24 g/m²) | Silver Iodobromide Emulsion (silver iodide: 5.5 mol%) (3.71 g/m²) | — | Yellow Colloidal Silver (0.124 g/m²) |
| Dry Film Thickness | 5 μ | 6 μ | 5 μ | 2 μ | 2 μ |

[1] 5-Hydroxy-7-methyl-1,3,8-triazaindene
[2] 2,4-Dichloro-6-hydroxy-1,3,5-triazine sodium salt
[3] Sodium p-dodecylbenzenesulfonate
[4] Sodium p-nonylphenoxypoly(ethyleneoxy)propanesulfonate sample in a 4 cm square, subjecting the cut pieces to humidity conditioning at a temperature of 30° C and a relative humidity of 90% in such a manner that the pieces did not contact each other, then stacking so that the uppermost layer and back layer of the pieces contacted each other, subjecting to humidity conditioning and placing a weight thereon for one day to provide a pressure of 50 g/cm², peeling these samples apart and measuring the adhered areas to determine the proportion of the contacted area in percent.

The results of the reticulation and adhesion evaluation of Samples 1 to 11 are shown in Table 2.

TABLE 2

| Evaluation | Sample 1 | 2 | 3 | 4 | 5 | 6 | 7 | 8 | 9 | 10 | 11 |
|---|---|---|---|---|---|---|---|---|---|---|---|
| Reticulation | C | A | D | A | A | B | A | A | A | A | A |
| Contacted Area (%,30° C,RH90%) | 85 | 95 | 15 | 20 | 15 | 15 | 15 | 15 | 20 | 20 | 15 |

Note:
A When observation was carried out with a microscope using a magnification of 30 times, no reticulation was observed.
B When observation was carried out with a microscope using a magnification of 30 times, reticulation was slightly observed
C When observation was carried out with a microscope using a magnification of 30 times, marked reticulation was observed.
D Maarked reticulation was observed with the naked eye.

As is apparent from the results of Table 2, the combined use of a gelatin derivative and silicic anhydride colloid results in a marked improvement in reticulation and adhesion resistance. In Sample 2 containing the gelatin derivative only, in particular, the reticulation resistance is improved as compared with Sample 1 containing gelatin only, but the adhesion resistance deteriorated. In Sample 3 containing gelatin and the silicic anhydride colloid, on the other hand, the adhesion resistance is improved as compared with Sample 1 containing gelatin only, but reticulation resistance tends to deteriorate. In Samples 4 to 11 containing the gelatin derivative and silicic anhydride colloid according to the present invention, however, both reticulation resistance and adhesion resistance are unexpectedly improved.

EXAMPLE 2

In an analogous manner to Example 1, polymethyl methacrylate particles having an average particle size of 2.1 microns as a matting agent and a silicic anhydride colloid similar to that of Example 1 were added to a protective layer of a photographic material, coated and dried to obtain Samples 21 to 26.

| Sample | Composition of Protective Layer |
|---|---|
| Sample 21 | Gd-3 + Polymethyl Methacrylate Particles (20 mg/g binder) |
| Sample 22 | Gd-3 + Polymethyl Methacrylate Particles (100 mg/g binder) |
| Sample 23 | Gd-3 + Silicic Anhydride Colloid (0.2 g/g binder) |
| Sample 24 | Gd-3 + Silicic Anhydride Colloid (0.5 g/g binder) + Polymethyl Methacrylate Particles (20 mg/g binder) |
| Sample 25 | Gd-3 + Silicic Anhydride Colloid (0.5 g/g binder) + Polymethyl Methacrylate Particles (100 mg/g binder) |
| Sample 26 | Gd-3 + Silicic Anhydride (2 g/g binder) |

When these samples were processed in an analogous manner to Example 1 and then observed by means of a microscope with a magnification of 50 times, no reticulation was found. These samples were subjected to an adhesion test in an analogous manner to Example 1 to obtain the results as shown in Table 3.

TABLE 3

| | Sample 21 | 22 | 23 | 24 | 25 | 26 |
|---|---|---|---|---|---|---|
| Contacted Area (%) (30° C, RH 90%) | 90 | 85 | 40 | 10 | 5 | 0 |

As is apparent from the results in Table 3, the adhesion resistance was not improved very much in spite of the amount of the matting agent being increased, but was markedly improved by increasing the quantity of silicic anhydride colloid. When the matting agent is used together with the silicic anhydride colloid, a photographic light-sensitive material having excellent reticulation resistance as well as adhesion resistance can be obtained.

EXAMPLE 3

On an undercoated polyethylene terephthalate film support were coated a silver halide emulsion layer and a protective layer in this order respectively to both surfaces and dried at a temperature of 25° C and a relative humidity of 60%. The matting agent and silicic anhydride colloid were added to the protective layer in a similar manner to Samples 21 to 26 except using Gd-1 as a binder and 50 mg of mucochloric acid as a hardener per g of the binder were used, thus obtaining Samples 31 to 36. The silicic anhydride colloid had an average particle size of 55 nm and was used in the form of a dispersion in methanol. In Sample 37, gelatin and polymethyl methacrylate were coated in an amount of 20 mg/g binder. As the emulsion layer, a silver iodobromide emulsion containing 1.5 mol% silver iodide, 50 mg of mucochloric acid as a hardener per g of gelatin and 5 mg of 1-phenyl-5-mercaptotetrazole as a stabilizer per g of gelatin was coated in a gelatin coverage of 2.48 g/m² and a silver coverage of 5.00 g/m². These samples were stored at a temperature of 25° C and relative humidity of 60% for one week and thereafter subjected to the following processing at 35° C. The occurrence of reticulation was observed with respect to each of these samples.

| | | |
|---|---|---|
| Development | 25 | seconds |
| Fixing | 25 | " |
| Water Washing | 20 | " |
| Developer Composition | | |
| Sodium Sulfite | 40 | g |
| Hydroquinone | 25 | g |
| Boric Acid | 10 | g |
| 1-Phenyl-3-pyrazolidone | 1.5 | g |
| Potassium Hydroxide | 30 | g |
| 5-Methylbenzotriazole | 0.15 | g |
| Glutaraldehyde Bisulfite | 15 | g |
| Acetic Acid | 12 | g |
| Potassium Bromide | 5 | g |
| Water to make | 1000 | ml |
| Fixing Solution | | |
| Ammonium Thiosulfate | 174 | g |
| Anhydrous Sodium Sulfite | 20 | g |
| Sodium Tetraborate (decahydrate) | 20 | g |
| Acetic Acid | 25 | g |
| Sulfuric Acid | 5 | g |
| Aluminum Sulfate | 7 | g |
| Water to make | 1000 | ml |

Then an adhesion test was carried out in a similar manner to Examples 1 and 2 except the protective layers contacted each other and the proportion of the contacted areas was obtained in percent.

The results of the reticulation and adhesion evaluation are shown in Table 4.

TABLE 4

| Evaluation | Sample 31 | 32 | 33 | 34 | 35 | 36 | 37 |
|---|---|---|---|---|---|---|---|
| Reticulation | A | A | A | A | A | A | D |
| Contacted Area (%) (30° C, RH 90%) | 95 | 90 | 50 | 20 | 10 | 5 | 90 |

As is evident from the results in Table 4, the combined use of the gelatin derivative and the silicic anhydride colloid resulted in a marked improvement in reticulation resistance and adhesion resistance as in Examples 1 and 2 and, when the matting agent was further used in combination, a photographic light-sensitive material having excellent adhesion resistance can be similarly obtained.

When other gelatin derivatives, silicic anhydride colloids and matting agents than those used in Examples 1 to 3 were used, excellent results were also obtained with respect to reticulation and adhesion resistance.

While the invention has been described in detail and with reference to specific embodiments thereof, it will be apparent to one skilled in the art that various changes and modifications can be made therein without departing from the spirit and scope thereof.

What is claimed is:

1. A photographic light-sensitive material comprising a support, a silver halide emulsion layer, and an uppermost layer thereon; said uppermost layer consisting essentially of a binder and a colloidal dispersion of silicic acid anhydride; said binder including a gelatin derivative in an amount of at least about 20% by weight based on the total weight of the binder in said uppermost layer; said silicic acid anhydride having a grain size of 1 nm to 150 nm; and said colloidal dispersion of silicic acid anhydride being employed in an amount of about 0.05 to 2.0 grams per gram of the total amount of binder in said uppermost layer.

2. The photographic light-sensitive material of claim 1, wherein the binder includes at least one material other than gelatin derivatives, selected from the group consisting of alkali-treated gelatins, acid-treated gelatins and enzyme-treated gelatins.

3. The photographic light-sensitive material of claim 1, wherein said colloidal dispersion of silicic acid anhydride is a colloidal dispersion of kaolin, diatomaceous earth, or bentonite.

4. The photographic light-sensitive material of claim 1, wherein said colloidal dispersion of silicic acid anhydride is a colloidal dispersion of silica.

5. The photographic light-sensitive material of claim 1, wherein the uppermost layer also include a hardener for the binder.

6. The photographic light-sensitive material of claim 5, wherein the hardener is a gelatin hardener selected from the group consisting of aldehyde hardeners, formaldehyde precursor type hardeners containing a methylol group or an alkylaminomethyl group, 1,4-dioxane hardeners, aziridine hardeners, isoxazole hardeners, carbodiimide hardeners, active halogen hardeners, active vinyl hardeners, high molecular weight hardeners and inorganic hardeners.

7. The photographic light-sensitive material of claim 1, wherein the binder includes at least one material selected from the group consisting of chemically modified or non-modified natural high molecular weight hydrophilic materials other than gelatin derivatives, wherein said chemically modified or non-modified natural high molecular weight hydrophilic materials other than gelatin derivatives are selected from the group consisting of acid-treated gelatin, alkali-treated gelatin, enzyme-treated gelatin, proteins, saccharides, agar-agar, gum arabic and cellulose derivatives; and synthetic high molecular weight materials of monomers having ethylenic double bonds.

8. The photographic light-sensitive material of claim 7, wherein the high molecular weight materials other than gelatin derivatives are alkali-treated gelatins, acid-treated gelatins, enzyme-treated gelatins, albumin, casein, agar, dextran, gum arabic, starch, carboxymethyl starch, carboxymethyl cellulose, hydroxyethyl cellulose, carboxymethylhydroxy ethyl cellulose, polyvinyl alcohol, partial hydrolyzates of polyvinyl acetate, poly-N-vinylpyrrolidone, polyacrylamide, polymethacrylamide, polyacrylic acid, polymethacrylic acid, polymethyl acrylate, polymethyl methacrylate, polysulfomethyl acrylate, polysulfomethyl methacrylate, polyglycidyl acrylate, polyglycidyl methacrylate, polyhydroxymethyl acrylate, polyhydroxymethyl methacrylate, polystyrene, polybutadiene, polyvinyl chloride, polyvinylidene chloride, polymaleic anhydride, polymaleimide, polyitaconic anhydride and copolymers of the above-described monomers as one component.

9. The photographic light-sensitive material of claim 7, wherein said synthetic high molecular weight materials of monomers having ethylenic double bonds are selected from the group consisting of polyvinyl alcohol, partial hydrolyzates of polyvinyl acetate, poly-N-vinylpyrrolidone, polyacrylamide, polyacrylic acid; aqueous dispersed latexes of copolymers or homopolymers of alkyl acrylates, alkyl methacrylates, acrylic acid, methacrylic acid, sulfoalkyl acrylates, sulfoalkyl methacrylates, glycidyl acrylates, glycidyl methacrylates, hydroxyalkyl acrylates, hydroxyalkyl methacrylates, alkoxyalkyl acrylates, alkoxyalkyl methacrylates, styrene, butadiene, vinyl chloride, maleic anhydride, maleamic acid, itaconic anhydride; and graft-type emulsion polymerization latexes obtained by polymerizing the previously identified vinyl compounds in the presence of hydrophilic high molecular weight protective colloids.

10. The photographic light-sensitive material of claim 1, wherein the uppermost layer also contains a matting agent.

11. The photographic light-sensitive material of claim 10, wherein the matting agent is selected from the group consisting of polymethyl acrylate, polymethyl methacrylate, polyacrylonitrile, acrylonitrile-$\alpha$-methylstyrene copolymers, polystyrene, styrene-divinylbenzene copolymers, polyvinyl acetate, polyethylene carbonate and polytetrafluoroethylene, methyl cellulose, ethyl cellulose, cellulose acetate and cellulose acetate propionate, carboxy starch, carboxynitrophenyl starch and urea-formaldehyde-starch reaction products, silicon dioxide, titanium dioxide, magnesium dioxide, aluminum oxide, barium sulfate, calcium sulfate, silver chloride and silver bromide desensitized in a conventional manner and glass.

12. The photographic light-sensitive material of claim 1, wherein said gelatin derivative is a reaction product of gelatin with at least one monofunctional compound having the functional groups selected from the group consisting of —NCO, —NCS, —NH- $COSO_3M$, $—NHCSSO_3M$ wherein M represents an alkali metal atom selected from sodium or potassium;

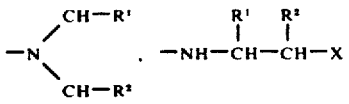

wherein $R^1$ and $R^2$ each is selected from hydrogen, methyl, ethyl, propyl, butyl or isobutyl and X is selected from chlorine, bromine or fluorine;

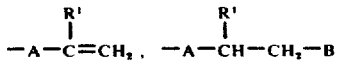

wherein $R^1$ has the same meaning as previously and A is selected from cyano, phenylsulfonyl, sulfamoyl, carbamoyl, sulfonyl or carbonyl and B is selected from bromine, chlorine, acetyl or a sulfonic acid ester group; $—SO_2X$ wherein X has the same meaning as previously; —COX wherein X has the same meaning as previously;

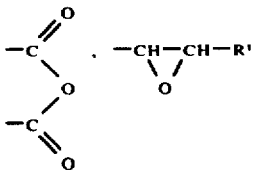

wherein $R^1$ has the same meaning as previously;

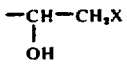

wherein X has the same meaning as previously; $—CH_2X$ wherein X has the same meaning as previously; $—COOR^3$ wherein $R^3$ is selected from o-nitrophenyl, p-nitrophenyl or p-carboxylphenyl; and

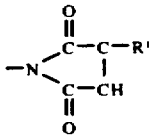

wherein $R^1$ has the same meaning as previously.

13. The photographic light-sensitive material of claim 12, wherein said monofunctional compounds are selected from the group consisting of isocyanates or precursors thereof, wherein said precursors are selected from the group consisting of phenyl isocyanate bisulfite adduct and biphenyl-4-isocyanate bisulfite adduct; thioisocyanates or precursors thereof, sulfonyl halides, carboxyl halides, acid anhydrides, compounds containing an oxirane ring or precursors thereof, halomethyl compounds, active esters, wherein said active esters are selected from the group consisting of o-nitrophenyl benzoate, p-nitrophenyl acetate and p-nitrophenyl-1-hydroxynaphthoate; and maleimides.

* * * * *